United States Patent [19]

Cechanski

[11] Patent Number: 4,525,225

[45] Date of Patent: Jun. 25, 1985

[54] SOLID WATER-IN-OIL EMULSION EXPLOSIVES COMPOSITIONS AND PROCESSES

[75] Inventor: Michael Cechanski, Nora, Sweden

[73] Assignee: Atlas Powder Company, Dallas, Tex.

[21] Appl. No.: 586,347

[22] Filed: Mar. 5, 1984

[51] Int. Cl.[3] ..... C06B 45/10

[52] U.S. Cl. ..... 149/19.5; 149/2; 149/19.91; 149/19.92; 149/21; 149/46; 149/61; 149/70; 149/76; 149/77; 149/85; 149/109.6

[58] Field of Search ..... 149/19.5, 2, 19.91, 149/19.92, 21, 46, 61, 70, 76, 77, 85, 109.6

[56] References Cited

U.S. PATENT DOCUMENTS

| | | | |
|---|---|---|---|
| 3,447,978 | 6/1969 | Blum | 149/2 |
| 4,110,134 | 8/1978 | Wade | 149/2 |
| 4,141,767 | 2/1979 | Sudweeks et al. | 149/2 |
| 4,216,040 | 8/1980 | Sudweeks et al. | 149/46 X |
| 4,231,821 | 11/1980 | Sudweeks et al. | 149/46 X |
| 4,322,258 | 3/1982 | Sudweeks et al. | 149/2 |
| 4,343,663 | 8/1982 | Breza | 149/4 |
| 4,356,044 | 10/1982 | Jessop et al. | 149/2 |
| 4,428,784 | 1/1984 | Jessop et al. | 149/2 |

*Primary Examiner*—Stephen J. Lechert, Jr.

*Attorney, Agent, or Firm*—Richards, Harris, Medlock & Andrews

[57] ABSTRACT

Solid water-in-oil emulsion explosive compositions comprising a discontinuous emulsion phase formed of an aqueous solution of an oxidizer salt and a continuous emulsion phase formed of a solid carbonaceous fuel derived from an oleaginous liquid. The continuous phase provides a self-sustaining matrix. A solid non-hygroscopic oxidizer salt, such as ammonium perchlorate, is dispersed in the emulsion in a solid granular form. Void cells are also dispersed within the emulsion to provide a void volume of at least 5%. The explosive compositions may be formulated to be sensitive to No. 8 blasting caps. Processes for forming the explosive compositions include the use of an oleaginous liquid of a polyester and styrene monomer mixture, which is emulsified with an aqueous solution of oxidizer salt without the addition of an emulsifying agent. The explosive composition may be formed as a unitary product or transformed into granular particulate form.

31 Claims, 2 Drawing Figures

SOLID WATER-IN-OIL EMULSION EXPLOSIVES COMPOSITIONS AND PROCESSES

TECHNICAL FIELD

This invention relates to a solid water-in-oil explosive composition and more particularly to such explosive compositions and methods of formulating same which may be rendered cap sensitive without the need for high explosive sensitizing agents.

BACKGROUND ART

There are a number of industrial applications in which formulations of detonable oxidizing salts, e.g., salts of nitric and perchloric acid, are employed in formulating blasting agents. The most widely used of these oxidizer salts is ammonium nitrate which is commonly employed in admixture with a light petroleum oil to produce the product termed "ANFO" (ammonium nitrate and fuel oil). ANFO is an economical and relatively safe explosive. However, ammonium nitrate is highly hygroscopic and becomes inert (deactivated to detonation) when contacted by water. Thus, unless special packaging steps are taken, the use of ANFO in an environment in which significant quantities of water are present is not advisable.

Some of the problems and difficulties involved in the use of ANFO and other oxidizer salt explosives may be avoided through the use of emulsion-type blasting agents. These agents comprise a discontinuous (internal) emulsion phase which is in the form of an aqueous solution of an oxidizer salt and a continuous (external) emulsion phase which is in the form of a carbonaceous fuel component. The external phase or the continuous fuel phase may be liquid semisolid, or solid. Thus, U.S. Pat. No. 3,447,978 to Bluhm discloses an emulsion type blasting agent in which the discontinuous emulsion phase is an aqueous solution of ammonium nitrate, optionally containing also a minor portion of a second oxidizer salt. The second oxidizer salt is usually sodium nitrate although other alkali metal or alkaline earth metal nitrates or perchlorates may also be used. Also disclosed for this purpose are ammonium chlorates or perchlorates, aluminum nitrate or chlorate, zinc nitrate, chlorate, or perchlorate, and organic oxidizing agents such as ethylene diamine dichlorate and ethylene diamine diperchlorate. The external emulsion phase comprises a wax and oil, a wax and a polymeric material, or a wax and a polymeric modified oil component. The external phase is liquid during the emulsion forming stage and after cooling may be a liquid, paste, or solid at the temperatures at which it is stored and used. The explosive composition of Bluhm also includes an occluded gas component dispersed within the emulsion and characterized as forming a discontinuous emulsion phase. The occluded gas component is incorporated in the emulsion by aeration or by the addition of hollow closed cells identified as microspheres, microbubbles or microballoons.

In the explosive composition described in Bluhm, the various component parts are present in amounts based upon 100 parts ammonium nitrate as a base. Thus, water is present in the amount of 10–60 parts by weight (preferably 18–44 parts by weight) and the carbonaceous fuel component in an amount within the range of 4–45 parts by weight (preferably 5–17 parts by weight). The occluded gas provided by entrained gas or closed cell voids is present in an amount of at least 4 volume percent.

The composition disclosed in Bluhm is described as being cap insensitive; that is, it is not subject to direct detonation by an electric blasting cap without the presence of a booster explosive component. U.S. Pat. No. 4,110,134 to Wade discloses a water-in-oil emulsion composition which can be formulated to provide no. 6 cap-sensitive explosive cartridges. In the Wade explosive composition, the discontinuous emulsion phase is an aqueous solution of an inorganic oxidizer salt composed principally of ammonium nitrate. The water concentration is about 10 to 22 weight percent of the emulsion. The continuous emulsion phase is present in an amount of about 3.5 to about 8 weight percent and comprises a hydrocarbon fuel including an emulsifier. Auxiliary fuels such as aluminum, aluminum alloys and magnesium may also be added in amounts up to about 15 weight percent. Also incorporated in the explosive composition of Wade is sufficient closed-cell void containing material providing an ultimate emulsion density within the range of about 0.9 to about 1.35 g/cc to render the explosive composition sensitive to a no. 6 electric blasting cap at a cartridge diameter of 1.25 inches. The closed cell void materials employed in Wade may be microspheres or microballoons of any suitable type and may be gas filled or evacuated. Suitable void cells include glass spheres, phenol formaldehyde microballoons and saran microspheres. The maximum density at which the explosive formulation may be detonated by a no. 6 blasting cap varies depending upon the water concentration and also as a function of the fuel and inorganic oxidizer content. Thus, the maximum density decreases as water concentration increases and also as wax in the continuous phase decreases. The maximum density is also decreased by replacing a secondary inorganic perchlorate component with an inorganic nitrate other than ammonium nitrate.

U.S. Pat. No. 4,343,663 to Breza discloses a solid water-in-oil emulsion explosive composition in which the continuous fuel phase is provided by cross-linking a liquid polymer to provide a thermoset resin. Thus, the continuous emulsion phase may be arrived at by cross-linking an unsaturated polyester resin with an ethylenically unsaturated cross-linking agent such as styrene monomer. The discontinuous emulsion phase in Breza comprises an aqueous solution of an oxidizer salt which is an ammonium, amine, alkali metal, or alkaline-earth metal salt of nitric acid or perchloric acid. The Breza explosive composition also comprises a sensitizer material dispersed in the martrix and/or the aqueous solution for inducing or enhancing the detonability of the solution-containing resin matrix. The sensitizer material may be a solid high explosive e.g. pentaerythritol tetranitrate, an organic nitrate ester or nitramine or the sensitizer may be totally nonexplosive, a dispersion of gas bubbles or voids, or the sensitizer material may be in part a dispersed solid high explosive. The relative concentrations of water in the discontinuous phase and resin in the continuous fuel phase vary depending upon the type of sensitizer employed. The resin content should be at least 4% by weight and in the case of a nonexplosive sensitized product, the resin content may not exceed 10% and preferably is no more than 8%. Where the product is high explosive sensitized, the resin content preferably is at least 12%. The water content should be at least 5% and generally at least about 8%, but should not exceed 25% by weight.

As noted previously, all or part of the sensitizer in Breza can be provided by dispersed gas bubbles or voids constituting at least about 5% of the product volume. The voids can be formed by direct gas injection, the in situ generation of gas, by mechanical agitation, or by the addition of particulate material such as phenol-formaldehyde or glass microballoons, fly ash, or siliceous glass. Preferred gas void volumes are in the range of about 5 to about 35%. The high explosive compositions in Breza which are sensitized with a high explosive are cap sensitive; that is, they may be directly detonated by a no 8 electric blasting cap. However, the explosive compositions sensitized with microballoons, even with the presence of monomethylamine nitrate are not directly cap sensitive, but are cap sensitive only with the presence of a booster such as Detaprime 16 or 33 gram boosters around the cap well.

DISCLOSURE OF THE INVENTION

In accordance with the present invention there are provided new and improved solid water-in-oil explosive compositions which may be formulated to be sensitive to a no. 8 blasting caps. In one aspect of the invention, there is provided a solid water-in-oil emulsion explosive comprising a continuous emulsion phase formed of a solid carbonaceous fuel which is derived from an oleaginous liquid. The continuous emulsion phase provides a self sustaining matrix. The discontinuous emulsion phase of the explosive is formed of an aqueous solution of a detonable oxidizer salt. The water content of the discontinuous aqueous phase is present in the emulsion in a weight concentration which is less than the weight concentration of the carbonaceous fuel phase. The explosive composition further comprises a solid nonhygroscopic oxidizer salt dispersed within the emulsion in a solid granular form. Void cells are dispersed within the emulsion in an amount to provide a void cell volume in the emulsion of at least 5 volume percent. Preferably the void cell volume expressed in terms of volume percent of the emulsion is greater than the quantity of water in the emulsion expressed in terms of weight percent of the emulsion.

In a further aspect of the invention there is provided a water-in-oil emulsion explosive composition comprising a continuous emulsion phase as described previously and a discontinuous emulsion phase formed of an aqueous solution of a detonable oxidizer salt which includes ammonium nitrate as the major component thereof. The composition includes void cells to provide a void volume of at least 5 volume percent as described previously and also includes ammonium perchlorate dispersed within the emulsion in a solid granular form.

In a further aspect of the invention there is provided a water-in-oil emulsion explosive comprising a continuous emulsion phase as described previously and a discontinuous emulsion phase formed of an aqueous solution of a detonable oxidizer salt. The composition includes void cells comprising a void volume of at least 5 volume percent as described above and includes a solid nonhygroscopic oxidizer salt dispersed within the emulsion in a concentration of at least 20 weight percent.

In another embodiment of the invention, there is provided a solid water-in-oil emulsion explosive which is in the form of unconsolidated particulate material, but which is still cap sensitive. The particulate solid emulsion explosive comprises a discontinuous emulsion phase, formed as described previously, which is hydrophobic and renders the particulate explosive water repellant so that it can be used in bore holes and the like which contain water. In still a further embodiment of the invention, there is provided a solid water-in-oil emulsion explosive which is deformable under applied stress while maintaining its integrity as a continuous body. The deformable or flexible explosive product, like the unconsolidated product, may be employed in environments in which an explosive is to be loaded into an irregularly shaped containment zone.

DESCRIPTION OF PREFERRED MODES

Figure 1:
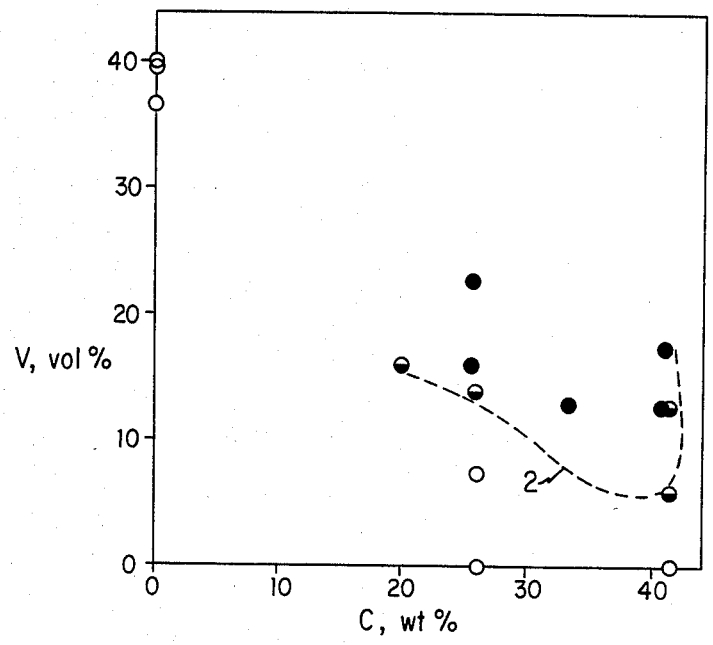
FIGS. 1 and 2 are graphs illustrating the relationship between the void volume and the concentration of dispersed solid oxidizer salt on cap sensitive and non cap sensitive emulsions prepared in the course of experimental work relative to the invention.

The present invention provides solid water-in-oil emulsion explosives which can be rendered cap sensitive through the proper selection and distribution of detonable oxidizer salts in both the continuous and discontinuous emulsion phases; and selection of the proper relative proportions of solid carbonaceous fuel in the continuous phase, water in the discontinuous phase, and void cell volume in the emulsion matrix.

Oxidizer salts which may be detonated and which are useful in formulating explosive compositions are well known to those skilled in the art and are disclosed in the aforementioned patents to Bluhm, Wade and Breza. As a practical matter, it usually will be preferred to employ ammonium nitrate as the principle oxidizer salt in aqueous solution in explosive compositions formulated in accordance with the present invention. However, other oxidizing salts such as those disclosed in the aforementioned patents to Bluhm, Wade and Breza may also be employed. Oxidizer salts which are useful in the present invention may be generally characterized as the alkali metal, ammonium, amine, or alkaline earth metal salts of nitric acid or of perchloric acid. In addition to the solution oxidizer salt in the discontinuous aqueous emulsion phase, the explosive compositions of the present invention also include an oxidizer salt dispersed within the emulsion in a solid granular form. The solid dispersed oxidizer salt preferably is nonhygroscopic; that is, it will not readily deliquesce in air having a humidity of 60–85% at standard temperature and pressure. Thus, ammonium perchlorate and sodium nitrate may be employed to form the solid dispersed phase of oxidizer salt, sodium perchlorate and ammonium nitrate should not be so employed since they are highly hygroscopic. It is preferred that at least a portion of the solid dispersed oxidizer salt take the form of ammonium perchlorate since it is a stronger oxidizing agent than the non-hygroscopic alkali metal nitrates. Where sodium nitrate (or another alkali metal nitrate) is employed in combination with ammonium perchlorate to provide the solid dispersed oxidizer salt, the total salt concentration in the solid dispersed phase will be somewhat higher than if ammonium perchlorate were employed alone. Also, the relative concentration of ammonium perchlorate in the solid emulsion will normally increase as the emulsion density increases.

The continuous emulsion phase in the explosive compositions of the present invention is a solid carbonaceous fuel which is derived from an oleaginous liquid which is initially emulsified with the aqueous solution of oxidizer salt. While the change of the continuous emulsion phase from the liquid to the solid state may be by any suitable physical or chemical mechanism which is compatible with the other emulsion components, as a practical matter it will be preferred to form the solid phase by a polymerization mechanism. Suitable liquid systems which may be polymerized to form a solid polymeric matrix are described in greater detail hereinafter.

The final emulsion component essential to the practice of the present invention is a void cell dispersion which is present in the emulsion in an amount to provide a void volume of at least 5%. The void volume may be provided by any suitable means including particulate solids such as hollow, closed cells which may be evacuated or gas filled, expanded, gas-entraining aggregates such as perlite and vermiculate, or occluded free gas such as air, carbon dioxide, nitrogen, or hydrogen. Various commercially available hollow closed-cell materials, which are commonly referred to as microballoons, microbubbles, or microspheres, may be employed in the present invention. These may be formed of any suitable materials such as glass, phenol-formaldehyde resins, and polyvinylidene chloride (saran) resins. Such hollow closed cell materials normally will be of an average particle size, i.e., nominal diameter, of less than 80 microns and a predominant particle size distribution within the range of about 10–100 microns. A typical average particle size is within the range of 30–70 microns. Suitable hollow closed-cell products which may be employed in the present invention are disclosed in the aforementioned patent to Wade and include saran microspheres having a diameter of about 30 microns and a particle density of about 0.032 g/cc, glass microbubbles having a particle size distribution in the range of about 10–160 microns and a nominal size within the range of about 60–70 microns and a density in the range of about 0.1–0.4 g/cc, and glass microbubbles having a particle size within the range of about 44–175 microns and a bulk density within the range of 0.15–0.4 g/cc. Other closed-cell materials include the phenolformaldehyde microballoons and inorganic microspheres as disclosed in the aforementioned Wade patent.

When plastic particulates, such as saran or phenol-formaldehyde micro balloons are added to provide the void cell volume, it will be recognized that these plastics will also serve as supplemental fuels.

Occluded free gas can be incorporated into the emulsion by any suitable physical or chemical procedures. Thus, gas can be entrained by stirring or other mechanical agitation or by aeration techniques involving the in situ injection of air (or other gas) into the emulsion while in the liquid state. Chemical procedures include the introduction of organic or inorganic foaming agents which react or decompose under the action of an appropriate stimulus to produce suitable gases such as carbon dioxide, nitrogen or hydrogen which are entrained within the emulsion as the continuous phase is solidified. Thus, suitable chemical foaming agents include organic foaming agents such as dinitroso compounds or diisocyanates which, upon heating, decompose to release nitrogen dioxide and carbon dioxide, respectively. Inorganic foaming agents which may be employed in order to produce occluded free gas within the emulsion include carbonates, bicarbonates, nitriles and peroxides. Where a chemical gas-generating or foaming agent is employed, the amount of chemical to be added to the emulsion can be determined by measuring the density of the emulsion without entrained gas, computing the gas generated by a given quantity of foaming agent and then adding the required amount of foaming agent.

Where the void volume is arrived at through the use of solid agents such as microballoons, microspheres and the like, the void cell material may be added before, during or after the formation of the liquid emulsion. Where chemical procedures are employed, the foaming agent should be added during or after formation of the liquid emulsion. Preferably such agents are added after emulsification of the aqueous phase and the oleaginous phase. Where free occluded gas is added by physical means such as gas injection or agitation, this step should be carried out subsequent to formation of the liquid emulsion.

The choice of materials employed to incorporate the desired void cell volume into the explosive composition of the present invention is determined to some extent by the environment in which the explosive is to be used. In a relatively high pressure environment, because of hydraulic tamping or otherwise, the void volume should be provided by solid materials such as glass or saran microballoons. In lower pressure environments, and also where it may be desirable to form a flexible explosive product as described in greater detail hereinafter, the void cell volume may be provided by occluded free gas.

The quantity of void cell volume introduced into the emulsion is at least 5 volume percent of the solid emulsion product. Usually it will be preferred to provide for a void cell volume of about 10 volume percent or more. The desired void volume incorporated into the explosive compositions of the present invention varies with the water content of the discontinuous emulsion phase, the cell size of the discontinuous emulsion phase, and the amount of solid oxidizer salt dispersed throughout the continuous emulsion phase. In general, the void cell volume should be increased as the water content of the composition increases and as the solid oxidizer salt content, particularly ammonium perchlorate, decreases. Also, all other things being equal, the void volume should be increased as the dispersed cell size of the discontinuous aqueous emulsion phase increases. As a practical matter, it will usually be desirable to retain the latter at an average cell size of about 10 microns or less. Further, it usually will be preferred to provide sufficient void volume within the explosive composition to provide a final composition density within the range of about 0.9–1.2 g/cc.

The continuous carbonaceous fuel phase in the solid emulsion of the present invention may be present in an amount within the range of 5–30 weight percent. The amount of carbonaceous fuel phase in the absence of a high explosive sensitizer need not be limited as in the case of the solid emulsion compositions disclosed in the aforementioned patent to Breza. Accordingly, a preferred application of the present invention is in those explosive compositions having a solid carbonaceous fuel phase in a concentration greater than 10 weight percent. As a practical matter it will usually be preferred to limit the continuous carbonaceous fuel phase to an amount of about 20% or less since greater amounts normally will be unnecessary in terms of either product integrity or fuel needs. The amount of carbonaceous fuel present in the solid emulsion may also be adjusted downward to compensate for supplemental fuels which may be present. Such supplemental fuels may include plastic particulates, as described previously, or supplemental fuels in the aqueous phase or as provided by disbursed metallic compounds, as described hereinafter.

The water content (in the discontinuous emulsion phase) of the solid emulsion of the present invention is somewhat less than the water concentrations generally called for in the aforementioned Wade and Breza patents. Preferably, the water concentration is less than the concentration of the solid carbonaceous fuel in the continuous emulsion phase in order to ensure blasting cap sensitivity. For this same reason it is also preferred that the void cell volume, expressed as volume percent of the emulsion, be greater than the water concentration in the emulsion expressed as a weight percent.

The total amount of oxidizer salt (in aqueous solution and in solid dispersion) employed in the present invention normally will fall within the range of 60–90 weight percent. Preferably inorganic oxidizer salts are employed in both the aqueous discontinuous phase and in the solid dispersed phase. The discontinuous emulsion phase may take the form of an aqueous solution of an inorganic oxidizer salt selected from the group consisting of alkali metal, ammonium, and alkaline-earth metal nitrates and alkali metal, ammonium, and alkaline-earth metal perchlorates and mixtures thereof. As noted previously, it will normally be preferred to employ, as the discontinuous emulsion phase, an aqueous solution of an oxidizer salt selected from the group consisting of ammonium nitrate, sodium nitrates and mixtures thereof. An especially suitable discontinuous phase comprises an aqueous solution of a mixture of ammonium nitrate and sodium nitrate, with ammonium nitrate present as the principal oxidizer component. Other water soluble additives may also be incorporated into the aqueous solution of oxidizer salt. Examples of such additives include alcohols, ureas, formamides and carbohydrates, such as sucrose, glucose and fructose, which will function as supplemental fuels.

While, as noted hereinafter, hygroscopic salts can in some cases be employed as the dispersed solid oxidizer salt, it usually will be desirable to employ a non-hygroscopic salt in this capacity and to employ a salt which is a strong oxidizing agent in comparison with the oxidizer salt content in the aqueous emulsion phase. Preferably the dispersed oxidizer salt is ammonium perchlorate.

The amount of oxidizer salt dispersed within the solid emulsion in a solid granular form will vary in a somewhat inverse relationship with the amount of oxidizer salt in aqueous solution within the discontinuous emulsion phase. The amount of solid dispersed oxidizer salt necessary to provide cap sensitivity also varies in a somewhat inverse relationship with respect to the void cell volume of the solid emulsion. Usually it will be preferred to employ solid oxidizer salt dispersed throughout the emulsion in a concentration of at least 20 weight percent.

The water-in-oil explosive emulsions of the present invention may be formulated to provide rigid nonplastic or nonyielding cast products as in the case of the explosive disclosed in the aforementioned patent to Breza. Alternative product forms may also be provided in accordance with the present invention. Thus, in a further embodiment of the invention, there is provided an explosive product which, while sufficiently firm to be self-sustaining is also deformable under an applied stress without disruption of its integrity. Deformable products of this nature may be advantageously employed in circumstances in which they are to be loaded into an irregularly shaped containment. For example, such products may be employed in seismic prospecting where they are loaded into irregularly shaped shot holes. Flexibility can be impaired to the product by increasing the occluded gas volume in relationship to the quantity of the solid carbonaceous fuel providing the continuous emulsion phase. As the ratio of occluded gas to the polymerized fuel phase increases, the average thickness of the polymeric material between the occluded gas cells decreases resulting in a less rigid structure. The flexibility of the explosive product can also be increased by the incorporation of suitable plasticizers into the polymeric fuel phase.

In a further embodiment of the invention there is provided a granular explosive product which, like the integral but flexible product described above, can be used in environments in which irregular shapes are called for. This product, which may be prepared as described in greater detail hereinafter, may be characterized as having an average particle size within the range of 0.1–5 millimeters. The granulated explosive product, like the integral product of the present invention can be advantageously used in wet conditions. In this regard, the product, though granular in nature, retains its water repellent characteristics because of the oleophilic nature of the granules resulting from the hydrophobic continuous emulsion phase.

As noted previously, it will normally be preferred, as a practical matter, to form the solid carbonaceous fuel phase by polymerization of the oleagineous liquid employed to form the liquid emulsion phase. While the polymeric fuel phase may be a monopolymer, it conveniently can take the form of a copolymer produced by cross-linking of an ethylenically unsaturated homopolymer or copolymer. Preferred cross-linking agents are styrene and other vinyl aromatics either alone or mixed with other ethylenically unsaturated monomers. In one embodiment of the invention, the continuous polymerizable fuel phase comprises an unsaturated polyester. Unsaturated polyester resins can be produced by reacting a polyhydric carboxylic acid and a polyhydric alcohol (or the anhydride of either or both of the foregoing) at the esterification temperatures, generally at least 150° C., until the acid value and the hydroxyl value of the reaction mixture has been reduced to values corresponding to a mean weight average molecular weight with the range of about 1,000–10,000. The polyester can be one or more $\alpha,\beta$-ethylenically unsaturated polyesters of an $\alpha,\beta$-ethylenically unsaturated carboxylic acid and/or anhydride thereof copolymerized with a polyhydric alcohol and/or alkylene oxide.

Preferably the polyhydric alcohols utilized are dihydric alcohols such as ethylene glycol; diethylene glycol; 1,2-propylene glycol; 1,2- or 1,3-dipropylene glycol; 1,3-propylene glycol; 1,3-butylene glycol; 1,2-butylene glycol; neopentyl glycol; 1,3-pentanediol; and 1,5-pentanediol. Polyhydric alcohols of higher order such as trimethylol propane and pentaerythritol can be used in minor amounts up to 5% by weight.

The carboxylic acids utilized to produce the unsaturated polyester resin can be unsaturated or saturated. Suitable unsaturated carboxylic acids for utilization in the present invention have from 3 to 36 and preferably about 4 to about 8 carbon atoms. Examples include maleic acid, fumaric acid, itaconic acid and their anhydrides. Saturated acids which can be utilized in the present invention include oxalic acid, malonic acid, adipic acid, succinic acid, and glutaric acid. Halogenated acids, such as tetrachlorophtalic acid, and tetrabromophtalic acid can also be employed.

A number of unsaturated polyester resins can be manufactured from known components and methods. Examples of unsaturated polyester resins suitable for use in the present invention are set forth below in Table I.

TABLE I

| Component | Suitable Resins by Parts by Weight | | |
|---|---|---|---|
| | Resin A | Resin B | Resin C |
| maleic anhydride | 1. | — | 23.1 |
| maleic acid | — | 1.0 | — |
| phthalic anhydride | 1. | — | 34.9 |
| propylene glycol copolymers | 1.8 | 2.2 | 37.7 |
| isophthalic acid | — | 1.0 | — |
| toluene diisocyanate | — | — | 4.3 |

It is preferred that the polyester resins include dicarboxylic acids as the major acid component. The molar ratio of unsaturated acids to saturated acids should be at least 1:5 in order to provide sufficient unsaturation for reaction with a copolymerizable solvent.

The unsaturated polyester resin is preferably carried within a monomer solvent to provide the oleaginous liquid from which the continuous emulsion phase is derived. Suitable monomer solvent include vinyl toluene, alpha-methyl styrene, acrylonitrile, ethylacrylate, methacrylate, methylmethacrylate, vinyl acetate, trialkylcyanuarate, diallylphthalate, ethylvinyl ether, and mixtures thereof. Styrene is a preferred solvent due to its cost, availability and reactivity.

It will be recognized that resins other than polyesters of the type described above may be utilized in the invention. For example, methylacrylates, acetates, butadienes, and acrylate nitriles may be employed to form the continuous emulsion phase. For the purposes of describing specific embodiments of the invention, reference will be made to polyester resins.

The liquid continuous phase, in addition to the polymerizable materials and oxidizer salts and void cell materials described previously, may also include other nonpolymerizable materials such as plasticizers, emulsifiers, organic die stuffs, auxiliary fuels and, in some cases, compatible high explosives. A plasticizer may be incorporated into the continuous phase in order to increase the flexibility of the final product, as noted previously. Any suitable plasticizer which is compatible with the particular resin selected for the polymerizable component can be used. Plasticizers and their uses are well known to those skilled in the art and for a further description thereof reference is made to Encyclopedia of Chemical Technology, Kirkothmer, 3rd Edition 1982, John Wiley & Sons, Vol. 18, pp. 111–183.

Die stuffs which may be used include inorganic pigments such as titanium dioxide or organic die stuffs such as phthalocyanines. Die stuffs are generally incorporated into explosive compositions for aesthetic rather than functional purposes.

Preferably, emulsifiers and plasticizers are added to the polymerizable continuous phase prior to the formation of the liquid emulsion. Fillers and organic die stuffs preferably are added after or during formation of the liquid emulsion but may be added to the continuous phase prior to admixture with the discontinuous phase.

The unsaturated resin, e.g. a polyester resin, cross-links with the monomer, e.g. styrene, to provide the final solid emulsion phase which is a copolymer of the resin and the monomer. Normally, an inhibitor is added to the polymeric fuel phase to prevent the cross-linking reaction prior to the desired time. Any inhibitor known in the polymer art, which is compatible with the other emulsion components can be used. Suitable inhibitors include the quinones and in particular methyl tertiarylbutyl hydroquinone and carus hydroquinone. Another suitable inhibitor is butylated hydroxytoluene (BHT). Normally the inhibitors will be employed in concentrations up to about 2000 ppm.

In most cases, an initiator will be added to begin the cross-linking of the polymerizable fuel phase. Such initiators are well known to those skilled in the art. When a polyester resin is used, the initiator is preferably one or more organic peroxides. Initiators which can be used to initiate cross-linking of polyester resin include hydroperoxides, diacylperoxides, ketoperoxides or organic peracids. Peroxides which are soluble in the polymerizable fuel phase are preferred.

Optionally, an accelerator can be used to accelerate the decomposition of the initiator system, thus permitting shorter curing times and/or lower curing temperatures. The accelerator is selected based upon the type of initiator utilized. Metal salts such as colbalt naphthenate are suitable accelerators for hydroperoxides, ketoperoxides and peracids. Other suitable accelerators are salts and soaps of metals which have a valence number greater than one. The most commonly utilized accelerators are colbalt and vanadium salts and soaps.

The time necessary to complete the cross-linking reaction depends upon a number of factors but is primarily determined by the type and relative quantities of the initiator, accelerator and inhibitor and the processing temperature. Many colbalt accelerated systems can be superactivated by the addition of selected amines. For example, a superactivated system includes methyl ethyl ketoperoxide, colbalt naphthenate and dimethylaniline. It is preferred in choosing an initiator system, whether it be the initiator alone or in combination with an acclerator and an inhibitor, that the decomposition temperature of the initiation system be lower than the processing temperature. The initiators and accelerators may be added to the polymerizable liquid in any suitable amounts. Preferred ranges of initiators and accelerators expressed as weight percent of the polymerizable fuel phase are: for peroxides, about 0.5%–5.0%; for metal salt accelerators about 0.001%–0.10% based upon the equivalent amount of metal concentration relative to the resin content; and for amine accelerators, about 0.001% to 1.0%.

In some cases, the explosive compositions of the present invention include an emulsifier which promotes the formation of a water-in-oil emulsion between the continuous polymeric fuel phase and the discontinuous aqueous oxidizer phase. Such emulsifiers may be of any suitable type and include benzyldimethylamine, trimethylhexamethylenediamine, isophorenediamine, morpholine and mixtures thereof, The amount of emulsifier utilized is dependent upon the particular emulsifier selected and the composition of the fuel phase and oxidizer phase. Normally the emulsifier is added to the polymeric fuel phase in an amount within the range of 0.1–2 weight percent.

The solid oxidizer salt can be dispersed throughout the emulsion by adding it to the liquid water-in-oil emulsion or by dispersing it within the oleagineous liquid prior to formation of the water-in-oil emulsion. The preferred mode usually will be to add the oxidizer salt to the formed emulsion. Where the oxidizer salt is added directly to the emulsion (or to the oil phase prior to emulsification) it is preferred that a non-hygroscopic salt be employed in order to avoid or at least reduce combination of the salt with water from the aqueous emulsion phase.

An alternative procedure for incorporating the solid oxidizer salt into the emulsion is to dissolve the salt in the aqueous solution at an elevated temperature to provide a salt concentration in excess of the saturation point at a lower temperature to which the explosive composition is then cooled. In this case, hygroscopic as well as non-hygroscopic salts may be employed. For example, ammonium nitrate is soluble in water to a concentration of 88 weight percent at 90°, 80 weight percent at 60° C. and 70 weight percent at 30° C. Thus, a saturated aqueous solution of ammonium nitrate at 90° C. may be emulsified with the oleagineous liquid from which the carbonaceous fuel phase is derived. As the emulsion cools and prior to solidification of the oil phase, some of the oxidizer salt will precipitate from the aqueous phase. After the continuous phase has been cured to form the solid emulsion matrix, further cooling will cause additional oxidizer salt to precipitate from solution at the interface between the dispersed emulsion cells and the continuous emulsion matrix.

The solid emulsion explosive products of the present invention may incorporate high explosives similarly as in the case of the solid emulsions disclosed in the aforementioned patent to Breza. Such explosives include pentaeryphritol tetranitrate (PETN), cyclotrimethylenetrinitramine (RDX) and cyclotetramethylenetetranitramine (HMX). Such high explosives, where employed, will normally be incorporated into the explosive product in concentrations of about 10–40 weight percent. However, a preferred application of the present invention is in the formulation of explosive products which are substantially free of such cap-sensitive high explosives. Such explosive free products are preferred from the standpoint of safety in processing and handling and because of economic considerations.

In one set of laboratory experiments carried out respecting the invention, cap-sensitive solid emulsion explosive compositions were formulated in which the void cell volume was provided by the occluded free gas generated in situ by a foaming agent. In each of these procedures, the continuous carbonaceous fuel phase was derived from a commercially available polyester and styrene monomer mixture available from the Ashland Chemical Company, Polyester Division, Columbus, Ohio under the trademark AROPOL WEP 662P. The following examples illustrate this laboratory work.

EXAMPLE 1

A first preblend was prepared by adding cobalt naphtanate, cobalt, dimethylaniline and tetrahydro-1,4-oxazine in respective amounts of 0.5, 6, 0.5, and 1 weight percent to the AROPOL WEP 662P resin mixture. These additives were mixed into the resin which then was heated to a temperature within the range of 80°–85° C. to provide a first preblend of oleaginous liquid. A second preblend of 90 parts by weight of an inorganic oxidizer solution comprising 70 parts by weight ammonium nitrate, 10 parts by weight sodium nitrate, and 10 parts by weight water was heated to 90° C. until the ammonium nitrate and sodium nitrate dissolved. The heated oxidizer solution was then gradually added to 15 parts by weight of the heated resin blend in a double blade Waring blender. A water-in-oil emulsion formed easily and the emulsion matrix was then transferred to a conventional cake mixer when N,N-dinitroso pentaminethylene tetramine (an organic foaming agent) was added in the amount of 0.14 weight percent (based upon the weight of the total emulsion. Thereafter, 2% by weight based on the resin of an initiator available from Lucidol Pennwalt Company under the trademark Lupersol DDM-9 (a mixture of 8.8% methylethylketone peroxide in a plasticizer) was added and the emulsion was thoroughly admixed.

The prepared emulsion was poured into cylindrical plastic molds being 2.5 inches (6.4 cm) in diameter by 6 inches (15.2 cm) in length. The emulsion explosive contained in the molds was heated on a steam bath for 10 to 15 minutes. This heating accelerated the curing rate at which the continuous polymeric fuel phase solidified. The dispersion was removed from the molds. The cooled dispersion was a solid, cross-linked polyester-styrene copolymer containing inorganic oxidizer droplets and gas bubbles uniformly distributed throughout the solid water-in-oil dispersion structure. The product had a density of 1.1 grams/cc. The molded unconfined sample weighing approximately 500 grams was detonated with a No. 8 electric blasting cap.

Several more solid emulsion explosives were made according to the above procedure and molded into different sizes. A cylindrical cartridge 1.125 inches in diameter by 6 inches in length having a density of 1.1 grams/cc was detonated by a No. 8 electric blasting cap when unconfined. A sample molded into a cylinder 2.5 inches in diameter by 12 inches in length having a density of 1.1 grams/cc was detonated with a No. 8 cap at a velocity of 4200 m/sec. A cartridge 2.5 inches by diameter by 6 inches in length with a density of 1.1 grams/cc, upon detonation by a No. 8 cap, impressed a lead block by 44%.

EXAMPLE 2

The procedure and formulation of Example 1 was repeated with the exception that the organic foaming agent was replaced by an inorganic foaming agent. Sodium nitrite in the amount of 0.14 weight percent was added to the liquid emulsion. The product was molded into cylinders 2.5 inches in diameter by 6 inches in length having a density of about 1.1 grams/cc. The cast dispersion explosive detonated completely with a No. 8 blasting cap.

EXAMPLE 3

Fifteen parts by weight of the liquid resin mixture AROPOL WEP 662P was heated to a temperature of 80° to 85° C. No accelerators or emulsifiers were added to the product prepared in this example. A second preblend of 90 parts by weight of an oxidizer solution comprising of 70 parts ammonium nitrate, 10 parts sodium nitrate, and 10 parts water was heated to about 90° C. until the ammonium nitrate and sodium nitrate dissolved. The heated oxidizer solution was gradually added to the heated resin in a double blade Waring blender. The water-in-oil emulsion formed easily. The emulsion matrix was then transferred to a conventional cake mixer. Next, 0.14% sodium bicarbonate based upon the weight of the emulsion matrix was added as an inorganic foaming agent. Immediately after addition of the foaming agent, 2 weight percent of the initiator Lupersol DDM-9 was added to the emulsion matrix. The product was placed in a mold 2½ inches in diameter by 10 inches in length and heated above a steam bath for about 10 to about 15 minutes. The cooled solid emulsion explosive was detonated by a No. 8 cap.

EXAMPLE 4

The procedure and formulation of Example 1 was repeated with the exception of the molding of the product. In this example, while the solid emulsion product was warm but only partially cross-linked, the product was mechanically crumbled into small granules and rapidly cured on a steam bath. While the particle size distribution varied over a wide range, the predominant particle size was about 2–5 millimeters. The resulting granular product was packed into plastic containers $2\frac{1}{2}$ inches in diameter and 6 inches long. One cylinder was loaded to a bulk density of 0.9 gm/cc and the other was more densely packed to provide a bulk density of 1.1 gm/cc. Both products were detonated with a number 8 cap leaving good impressions on iron witness plates.

EXAMPLE 5

In this example, the oleaginous fuel phase was prepared by mixing 107 parts by weight of the resin mixture AROPOL WEP 662P with 2 parts of morpholine. The aqueous oxidizer phase comprised 250 parts by weight ammonium nitrate, 72 parts by weight sodium nitrate, and 72 parts by weight water. The two phases were mixed together and emulsified. After formation of the emulsion, 350 parts by weight of granular ammonium perchlorate and 2 parts by weight of methylethylketone peroxide were added to the emulsion. An organic foaming agent, N,N-dinitroso pentaminethylene tetramine was added to a plurality of samples in amounts ranging from about 0.1–0.2 weight percent to form products having various occluded gas volumes. The emulsions were then solidified to produce solid emulsions having densities varying from about 1.0–1.2 gm/cc. Those products having densities within the range of about 1.0 gm/cc to about 1.2 gm/cc were sensitive to a number 8 electric blasting cap. In addition these formulations provided products which were deformable under moderate stress.

In further experimental work relative to the invention, a large number of solid explosive cartridges were formulated using three liquid emulsion systems. In each liquid emulsion, the oleaginous liquid was a 98 weight percent polyester and styrene mixture containing 2 weight percent morpholine as an emulsifying agent. This oleaginous liquid was mixed with aqueous solutions of ammonium nitrate and sodium nitrate to form liquid emulsion systems identified herein as emulsions I, II and III. The oil and water phases were heated to temperatures of about 60° and 80° C., respectively, and then stirred for a suitable period of time, e.g. 1–3 minutes, until relatively homogeneous emulsions were formed. Emulsion I contained 15% water 15% sodium nitrate 50% ammonium nitrate and 20% of the liquid resin mixture. Emulsion II contained 25% water, 40% ammonium nitrate 15% sodium nitrate, and 20% liquid resin. Emulsion III contained 15.5% water, 51% ammonium nitrate, 15.5% sodium nitrate, and 18% resin. All concentrations given herein are expressed in terms of weight percent unless designated otherwise.

After formation of the emulsion, additional ingredients were incorporated. In most cases, the added ingredients included saran microballoons and ammonium perchlorate crystals. After addition of the microballoons and crystalline ammonium perchlorate, the liquid emulsion was thoroughly mixed to disperse the solid additives throughout the emulsion system. Thereafter methylethylketone peroxide was added in an amount of about 0.2–0.3 weight percent. The emulsion was again stirred to distribute the initator throughout the system and then poured into molds to form cartridges having a diameter of about $2\frac{5}{8}$ inches and a length of $4\frac{1}{4}$ inches. The cartridges were cured at a temperature of about 90° C. for about 5–10 minutes and then allowed to cool. The cartridges were then removed from their molds and tested with number 8 electric blasting caps.

The results of this set of experiments are tabulated in Tables II through V. In the tables the component concentrations are given in weight percents unless indicated otherwise and the detonation results are designated as D for complete detonation, P for partial detonation and F for failure to detonate. The solid emulsion explosives derived from liquid Emulsion I are set forth in Tables II and III, and those derived from liquid emulsions II and III are set forth in Tables IV and Table V, respectively.

From an examination of the experimental data, it will be recognized that castings formed from emulsion II, which resulted in a final formulation having a water content substantially greater than the resin content, consistently failed to detonate. This was true even in those cases in which void-cell volumes and solid ammonium perchlorate concentrations were sufficient to cause cap sensitivity of other formulations having somewhat lower water contents.

TABLE II

| | 1 | 2 | 3 | 4 | 5 | 6 | 7 | 8 |
|---|---|---|---|---|---|---|---|---|
| Resin | 15.9 | 13.2 | 11.7 | 14.7 | 19.7 | 14.7 | 19.7 | 11.7 |
| Ammonium Nitrate | 39.7 | 33.1 | 29.2 | 36.7 | 49.3 | 36.8 | 49.2 | 29.2 |
| Sodium Nitrate | 11.9 | 9.9 | 8.8 | 11.0 | 14.8 | 11.0 | 14.8 | 8.8 |
| Water | 11.9 | 9.9 | 8.8 | 11.0 | 14.8 | 11.0 | 14.8 | 8.8 |
| Ammonium Perchlorate | 19.8 | 33.1 | 40.9 | 25.7 | — | 25.7 | — | 41.0 |
| Cells, wt. % | 0.6 | 0.5 | 0.5 | 0.7 | 1.1 | 0.5 | 1.2 | 0.4 |
| Initiator | 0.2 | 0.2 | 0.2 | 0.2 | 0.3 | 0.2 | 0.3 | 0.2 |
| Cell Volume % | 16.1 | 13.3 | 17.4 | 23.3 | 40.7 | 16.1 | 39.6 | 13.6 |
| Result | P | D | D | D | F | D | F | D |

TABLE III

| | 9 | 10 | 11 | 12 | 13 | 14 |
|---|---|---|---|---|---|---|
| Resin | 11.7 | 11.8 | 11.7 | 11.7 | 11.7 | 14.8 |
| Ammonium Nitrate | 29.4 | 36.9 | 29.3 | 36.8 | 29.3 | 36.9 |
| Sodium Nitrate | 8.8 | 11.1 | 8.8 | 11.0 | 8.8 | 11.1 |
| Water | 8.8 | 11.1 | 8.8 | 11.0 | 8.8 | 11.1 |
| Ammonium Perchlorate | 41.1 | 25.9 | 41.0 | 25.8 | 41.0 | 25.8 |
| Cells, wt. % | — | — | 0.3 | 0.4 | 0.1 | 0.2 |
| Initiator | 0.2 | 0.2 | 0.2 | 0.2 | 0.2 | 0.2 |
| Cell Volume % | — | — | 11.3 | 13.9 | 6.1 | 7.7 |
| Result | F | F | P | P | P | F |

TABLE IV

| | 15 | 16 | 17 | 18 | 19 | 20 | 21 | 22 | 23 |
|---|---|---|---|---|---|---|---|---|---|
| Resin | 19.8 | 14.7 | 11.7 | 19.9 | 14.7 | 11.7 | 19.9 | 11.7 | 14.8 |
| Ammonium Nitrate | 39.6 | 29.4 | 23.4 | 39.7 | 29.5 | 23.4 | 39.9 | 23.5 | 29.6 |
| Sodium Nitrate | 14.8 | 11.0 | 8.8 | 14.9 | 11.1 | 8.8 | 15.0 | 8.8 | 11.1 |

TABLE IV-continued

| | 15 | 16 | 17 | 18 | 19 | 20 | 21 | 22 | 23 |
|---|---|---|---|---|---|---|---|---|---|
| Water | 24.7 | 18.4 | 14.6 | 24.8 | 18.4 | 14.6 | 24.9 | 14.7 | 18.5 |
| Ammonium Perchlorate | — | 25.7 | 41.0 | — | 25.8 | 40.9 | — | 41.1 | 25.9 |
| Cells, wt. % | 0.8 | 0.6 | 0.6 | 0.3 | 0.2 | 0.4 | — | — | — |
| Initiator | 0.3 | 0.2 | 0.2 | 0.3 | 0.2 | 0.2 | 0.3 | 0.2 | 0.2 |
| Cell Volume % | 21.3 | 16.6 | 11.4 | 11.6 | 8.8 | 14.8 | — | — | — |
| Result | F | F | F | F | F | F | F | F | F |

TABLE V

| | 24 | 25 | 26 | 27 | 28 | 29 | 30 | 31 |
|---|---|---|---|---|---|---|---|---|
| Resin | 13.3 | 10.5 | 13.3 | 17.9 | 10.5 | 10.5 | 13.3 | 10.5 |
| Ammonium Nitrate | 37.5 | 29.9 | 37.6 | 50.6 | 29.9 | 29.9 | 37.6 | 29.9 |
| Sodium Nitrate | 11.4 | 9.1 | 11.4 | 15.4 | 9.1 | 9.1 | 11.4 | 9.1 |
| Water | 11.4 | 9.1 | 11.4 | 15.4 | 9.1 | 9.1 | 11.4 | 9.1 |
| Ammonium Perchlorate | 25.8 | 41.0 | 25.8 | — | 41.0 | 41.0 | 25.8 | 41.0 |
| Cells, wt. % | 0.4 | 0.3 | 0.2 | 0.5 | 0.2 | 0.2 | 0.2 | 0.3 |
| Initiator | 0.2 | 0.2 | 0.2 | 0.3 | 0.2 | 0.2 | 0.2 | 0.2 |
| Cell Volume % | 13.1 | 10.8 | 7.4 | 19.0 | 8.1 | 9.8 | 9.7 | 10.7 |
| Result | D | D | F | F | P | D | P | D |

Figure 2:
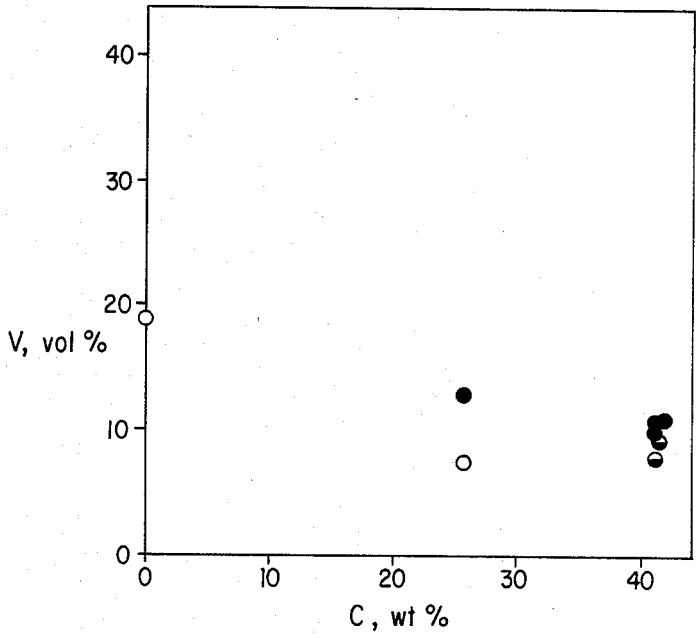

The results of the detonation test for the solid emulsion explosives derived from emulsions I (Tables II and III) and III (Table V) are set forth in FIGS. 1 and 2, respectively. The figures are data point representations of detonation, ● partial detonation, ● and failure to detonate, O, plotted as a function of the void-cell volume, V, on the ordinate versus the ammonium perchlorate concentration, C, on the abscissa. From an examination of the experimental results plotted in FIGS. 1 and 2, it can be seen that there is a region of detonability, as indicated, for example, by broken line 2 drawn through the partial detonation points of FIG. 1, which is dependent upon void cell volume and ammonium perchlorate concentration. Where a substantial quantity of ammonium perchlorate is present, and so long as the water content is maintained below the resin content, at least partial detonation can be achieved with only modest quantities of the saran microballoon. This is shown, for example, by test 13 (Table III) and test 28 (Table V). On the other hand, where ammonium perchlorate was absent, partial detonation was not achieved for void-cell volumes ranging from about 19 percent (test 27) to almost 41 percent (test 5). In these cases, detonation was not achieved even though the water content was less than the resin content and also less than the void cell content expressed as a volume percent. The water content was somewhat more than would normally be considered acceptable. In this regard, it usually will be preferred to limit the water content of the solid emulsion explosive to a value of about 12 weight percent or less.

It will be noted that in every case in which complete detonation was achieved, the resin content was greater than 10% and the water content was less than the resin content, albeit in some cases by only a relatively small increment. Also, the void cell content, expressed as volume percent, was in every case greater than the weight percent of water in the solid emulsion.

Further experimental work was carried out relative to the detonability of additional solid explosives derived from the emulsions identified previously as emulsions I, II and III. These tests demonstrated the effect of density (as determined by void cell content) and showed that detonability could be achieved for systems having very low resin concentrations so long as the water content was maintained at a value below the resin content. The results of this experimental work are set forth in Table VI.

TABLE VI

| | 32 | 33 | 34 | 35 | 36 | 37 | 38 | 39 |
|---|---|---|---|---|---|---|---|---|
| Resin | 20 | 13 | 13 | 6 | 6 | 6 | 5.4 | 5.4 |
| Ammonium Nitrate | 50 | 33 | 33 | 15 | 15 | 12 | 15 | 15 |
| Sodium Nitrate | 15 | 9.8 | 9.8 | 4.5 | 4.5 | 4.5 | 4.7 | 4.7 |
| Water | 15 | 9.8 | 9.8 | 4.5 | 4.5 | 7.8 | 4.7 | 4.7 |
| Ammonium Perchlorate | — | 35 | 35 | 70 | 70 | 70 | 70 | 70 |
| Density | .98 | 1.13 | 1.07 | 1.16 | 1.13 | 1.01 | 1.24 | 1.21 |
| Result | F | F | D | F | D | F | F | D |

In this set of tests, the explosive compositions were formulated in accordance with the procedure described previously except that the explosive compositions were tested as cartridges $2\frac{1}{2}$ inches in diameter and 5 inches long. For the experimental work set forth in Table VI tests 32 through 36 were derived from emulsion number I, test 37 from emulsion II, and tests 38 and 39 from emulsion III. The component concentrations and results are set forth similarly as described before. In addition, the density of the final product is also set forth.

As indicated by Example 3, described previously, the liquid water-in-oil emulsion from which the solid product is derived can be prepared without the use of a separate emulsifying agent. This is advantageous from the standpoint of simplifying the manufacturing procedure and also in terms of economics. The liquid resin system employing in this embodiment of the invention is a polyester and styrene monomer mixture containing polyester in an amount within the range of 35–45 weight percent and styrene in an amount within the range of 55–65 weight percent. The polyester resin should be free of acid groups or have an acid content of 2.25 weight percent or less of the polyester. The polyester in the mixture should have an average mean molecular weight within the range of 1,000–10,000, and a viscosity at room temperature, about 20°–25° C., within the range of 125–135 centipoises. The styrene polyester mixture described above will readily emulsify with the aqueous oxidizer solution when mixed therewith and agitated at a temperature within the range of about 60°–90° C. The previously described resin mixture available under the trademark AROPOL WEP, 662P is suitable for formulating liquid emulsions without the use of emulsifying agents.

As indicated by the previous Example 4, the solid emulsion explosives of the present invention, will retain their cap sensitivity, even though made in a particulate, unconsolidated form. In a further embodiment of the invention, explosive compositions of this character are made by forming the liquid emulsion from the aqueous solution of oxidizer salt and polymerizable oleaginous liqulid and subsequently transforming the emulsion into discrete granules. Preferably, the granularization step is carried out after partial polymerization (cross-linking) of the continuous emulsion phase. After transforming the material into the granular form, the polymerization reaction is carried to completion to provide the granular product. The emulsion may be granularized by a prilling procedure in which the emulsion is sprayed from a nozzle through a suitable medium, e.g. countercurrent flowing air, or it can be mechanically granularized, such as by extruding through a screen, grinding (of the partially cross-linked product), or by any other suitable technique.

Having described specific embodiments of the present invention, it will be understood that certain modifications thereof may be suggested to those skilled in the art and it is intended to cover all such modifications as fall within the scope of the appended claims.

I claim:

1. A solid water-in-oil emulsion explosive composition comprising:

(a) a continuous emulsion phase formed of a solid carbonaceous fuel derived from an oleaginous liquid and providing a self-sustaining matrix;

(b) a discontinuous emulsion phase formed of an aqueous solution of a detonatable oxidizer salt, the water content of said discontinuous phase being present in a concentration by weight which is less than the concentration by weight of said solid carbonaceous fuel;

(c) a solid non-hygroscopic oxidizer salt dispersed within said emulsion in a solid granular form; and (d) void cells dispersed within said emulsion in an amount to provide a void cell volume in said emulsion of at least 5 volume percent.

2. The composition of claim 1 wherein the void cell volume expressed as a volume percent of said emulsion is greater than the quantity of water in said emulsion expressed as a weight percent of said emulsion.

3. The composition of claim 1 wherein said solid carbonaceous fuel is present in said emulsion in a concentration greater than 10 weight percent.

4. The composition of claim 1 wherein said discontinuous emulsion phase is an aqueous solution of an inorganic oxidizer salt selected from the group consisting of alkali metal, ammonium and alkaline-earth metal nitrates and alkali metal, ammonium, and alkaline-earth metal perchlorates and mixtures thereof.

5. The composition of claim 1 wherein said aqueous phase contains an oxidizer salt which is a weaker oxidizing agent than said dispersed solid oxidizing salt.

6. The composition of claim 1 wherein said discontinuous emulsion phase comprises an aqueous solution of an inorganic oxidizer salt selected from the group consisting of ammonium nitrate, sodium nitrate and mixtures thereof.

7. The composition of claim 6 wherein said dispersed solid oxidizer salt comprises ammonium perchlorate.

8. The combination of claim 7 wherein said ammonium perchlorate is present in said emulsion in a concentration of at least about 20 weight percent.

9. The composition of claim 1 wherein said discontinuous phase comprises an aqueous solution of a mixture of ammonium nitrate and sodium nitrate.

10. The composition of claim 9 wherein the concentration of ammonium nitrate in said mixture is greater than the concentration of sodium nitrate therein.

11. The combination of claim 1 wherein said explosive composition is substantially free of a cap-sensitive high explosive.

12. The composition of claim 11 wherein the void cell volume is at least 10 volume percent of said emulsion.

13. A solid water-in-oil emulsion explosive composition comprising:

(a) a continuous emulsion phase formed of a solid carbonaceous fuel derived from an oleaginous liquid and providing a self-sustaining matrix;

(b) a discontinuous emulsion phase formed of an aqueous solution of a detonable oxidizer salt including ammonium nitrate as the major component thereof;

(c) a solid detonable oxidizer salt including ammonium perchlorate dispersed within said emulsion in a solid granular form and (d) void cells dispersed within said emulsion in an amount to provide a void cell volume in said emulsion of at least 5 volume percent.

14. The composition of claim 13 wherein said void cell volume expressed as a volume percent of said emulsion is greater than the quantity of water in said discontinuous emulsion phase expressed as a weight percent of said emulsion.

15. The composition of claim 14 wherein the concentration by weight of the water content of said discontinuous phase is less than the concentration by weight of said solid carbonaceous fuel.

16. The method of claim 15 wherein said solid carbonaceous fuel is present in said emulsion in a concentration greater than 10 weight percent.

17. The combination of claim 13 wherein said ammonium perchlorate included within said dispersed solid oxidizer salt is present in said emulsion in a concentration of at least 20 weight percent.

18. The composition of claim 13 wherein said oxidizer salt in said discontinuous emulsion phase comprises sodium nitrate is a minor component thereof.

19. The composition of claim 18 wherein the void cell volume of said emulsion is at least 10 volume percent of said emulsion.

20. A solid water-in-oil emulsion explosive composition comprising:

(a) a continuous emulsion phase formed of a solid carbonaceous fuel derived from an oleaginous liquid and providing a self-sustaining matrix;

(b) a discontinuous emulsion phase formed of an aqueous solution of a detonable oxidizer salt;

(c) a solid non-hygroscopic oxidizer salt dispersed within said emulsion in a solid granular form in a concentration of at least 20 weight percent and (d) void cells dispersed within said emulsion in an amount to provide a void volume in said emulsion of at least 5 volume percent.

21. The composition of claim 20 wherein the void cell volume expressed as a volume percent of said emulsion is greater than the quantity of water in said emulsion expressed as a weight percent of said emulsion.

22. The composition of claim 21 wherein said discontinuous emulsion phase is an aqueous solution of an inorganic oxidizer salt selected from the group consisting of alkali metal, ammonium, and alkaline earth metal nitrates and alkali metal, ammonium, and alkaline earth metal perchlorates and mixtures thereof.

23. The composition of claim 22 wherein said discontinuous emulsion phase comprises an aqueous solution of an inorganic oxidizer salt selected from the group consisting of ammonium nitrate, sodium nitrate and mixtures thereof.

24. The composition of claim 23 wherein said dispersed solid oxidizer salt and said discontinuous aqueous phase are present in a total concentration within said emulsion of at least 70 weight percent.

25. The composition of claim 24 wherein the void cell volume of said emulsion is at least 10 volume percent of said emulsion.

26. The composition of claim 25 wherein said explosive composition is substantially free of a cap-sensitive high explosive.

27. A solid water-in-oil emulsion explosive composition comprising:

(a) a continuous emulsion phase formed of a solid carbonaceous fuel derived from an oleaginous liquid and providing a self-sustaining matrix;

(b) a discontinuous emulsion phase formed of an aqueous solution of a detonatable oxidizer salt;

(c) a solid oxidizer salt dispersed within said emulsion in a solid granular form;

(d) void cells dispersed within said emulsion in an amount to provide a void cell volume in said emulsion of at least 5 volume percent; and (e) said explosive composition being in the form of unconsolidated particles having a size within the range of 0.1–5 millimeters, said particles having hydrophobic surfaces provided by said continuous emulsion phase.

28. A solid water-in-oil emulsion explosive composition comprising:

(a) a continuous emulsion phase formed of a solid carbonaceous fuel derived from an oleaginous liquid and providing a self-sustaining matrix;

(b) a discontinuous emulsion phase formed of an aqueous solution of a detonatable oxidizer salt;

(c) a solid oxidizer salt dispersed within said emulsion in a solid granular form;

(d) void cells dispersed within said emulsion in an amount to provide a void cell volume in said emulsion of at least 5 volume percent; and (e) said explosive composition being in the form of a continuous body which is deformable under an applied stress while maintaining its integrity as a continuous body.

29. In a method of making a solid water-in-oil emulsion explosive composition, the steps comprising:

(a) forming an admixture of (i) an oleaginous liquid comprising a polyester and styrene monomer mixture containing polyester in an amount within the range of 35–45 weight percent and styrene in the amount within the range of 55–65 weight percent, said polyester having an acid content of no more than 2.25 weight percent and an average mean molecular weight within the range of 1,000–10,000 and a viscosity at room temperature of the styrene-polyester mixture within the range of 125–135 centiposes; and (ii) an aqueous solution of an inorganic oxidizer salt (b) agitating said admixture to form an emulsion of said aqueous solution of oxidizer salt as the discontinuous phase and said oleaginous liquid as the continuous phase without the addition of an emulsifying agent;

(c) prior to step (d) adding a void cell incorporating agent to said admixture;

(d) initiating a cross linking reaction between said styrene and said polyester resin whereby said oleaginous liquid is polymerized to form a solid self-sustaining matrix for said emulsion.

30. In a method of making a solid water-in-oil emulsion explosive composition in granular form the steps comprising:

(a) forming an admixture of a polymerizable oleaginous liquid and an aqueous solution of a inorganic oxidizer salt;

(b) emulsifying said admixture to form a water-in-oil emulsion of said aqueous solution of oxidizer salt as the discontinuous phase and said oleaginous liquid as the continuous phase;

(c) prior to step (d), adding a void cell incorporating agent to said admixture;

(d) transforming said emulsion into granular particle form;

(e) polymerizing said continuous emulsion phase to provide a solid self-sustaining emulsion matrix in said particles whereby said granular particles have hydrophobic surfaces to render them water repellent.

31. The method of claim 30 wherein said emulsion is transformed into granular form after partial polymerization of said continuous emulsion phase and thereafter carrying the polymerization reaction to completion to provide said granular product.

* * * * *

UNITED STATES PATENT AND TRADEMARK OFFICE

CERTIFICATE OF CORRECTION

PATENT NO. : 4,525,225

DATED : June 25, 1985

INVENTOR(S) : Michael Cechanski

It is certified that error appears in the above-identified patent and that said Letters Patent is hereby corrected as shown below:

Column 8, line 3, change "impaired" to --imparted--.

Column 12, line 33, change "by" to --in--.

Column 15, line 29, change "of detonation, ● partial detonation, ● and failure" to --of detonation, ●, partial detonation, ●, and failure--.

Signed and Sealed this

Twenty-first Day of October, 1986

[SEAL]

*Attest:*

DONALD J. QUIGG

*Attesting Officer*

*Commissioner of Patents and Trademarks*